US005695057A

United States Patent [19]

Sullivan

[11] Patent Number: 5,695,057

[45] Date of Patent: Dec. 9, 1997

[54] THERMO-FORMED PACKING ELEMENT FOR FLOURESCENT TUBE

[75] Inventor: Michael W. Sullivan, Topeka, Kans.

[73] Assignee: Lawrence Paper Company, Lawrence, Kans.

[21] Appl. No.: 617,381

[22] Filed: Mar. 18, 1996

[51] Int. Cl.[6] ..... B65D 85/42

[52] U.S. Cl. ..... 206/418; 206/443

[58] Field of Search ..... 206/418, 419, 206/421, 443, 564, 589, 592

[56] References Cited

U.S. PATENT DOCUMENTS

| | | | |
|---|---|---|---|
| D. 328,034 | 7/1992 | Creaden . | |
| 3,301,013 | 5/1989 | Creaden . | |
| 4,613,042 | 9/1986 | Aeschliman | 206/419 |
| 4,705,170 | 11/1987 | Creaden . | |
| 4,792,045 | 12/1988 | Creaden . | |
| 4,834,239 | 5/1989 | Osgood | 206/418 |
| 4,936,453 | 6/1990 | Knitter . | |
| 5,016,751 | 5/1991 | Creaden . | |
| 5,058,744 | 10/1991 | Creaden . | |

*Primary Examiner*—Jacob K. Ackun

*Attorney, Agent, or Firm*—Hovey, Williams, Timmons & Collins

[57] ABSTRACT

A unitary, thermo-formed synthetic resin packing element (10) is provided which is adapted to fit over the ends of a pair of fluorescent tubes (50, 52). The element (10) includes a pair of elongated, juxtaposed, interconnected tubular members (16, 18) each having a closed end (20, 22) and a series of axially extending, deformable, concavo-convex ribs (34, 36). The central axes (46, 48) of the tubular members (16, 18) are preferably non-parallel prior to fitting of the tubular members (16, 18) over the ends of the fluorescent tubes (50, 52); this assists in maintaining the element (10) in place and increases the overall integrity of the final two fluorescent tube package (66).

23 Claims, 2 Drawing Sheets

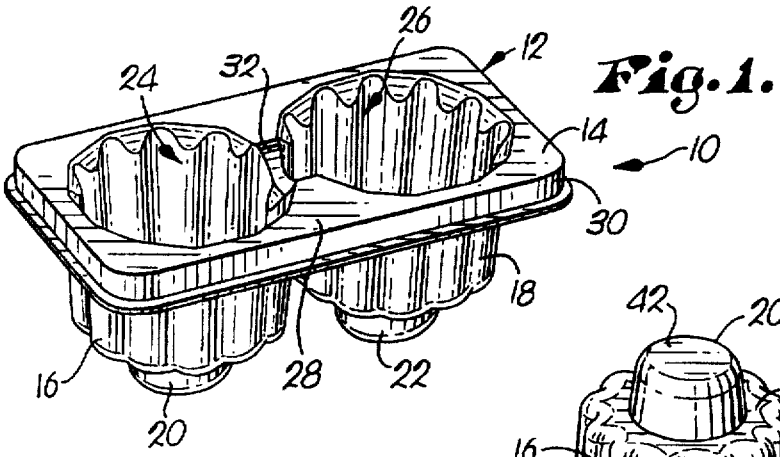
Fig.1.
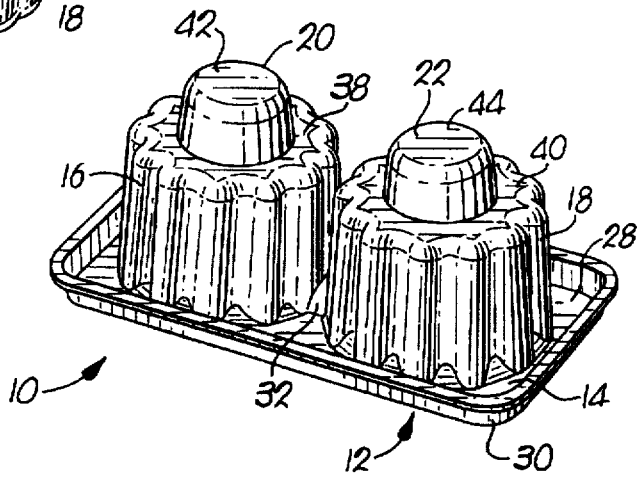
Fig.2.
Fig.3.
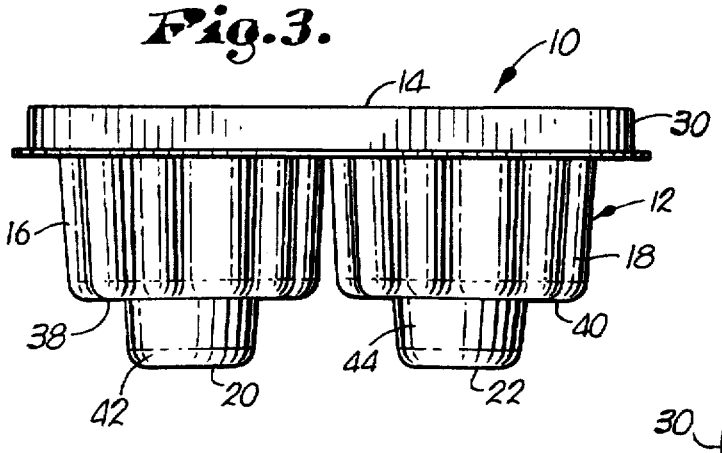
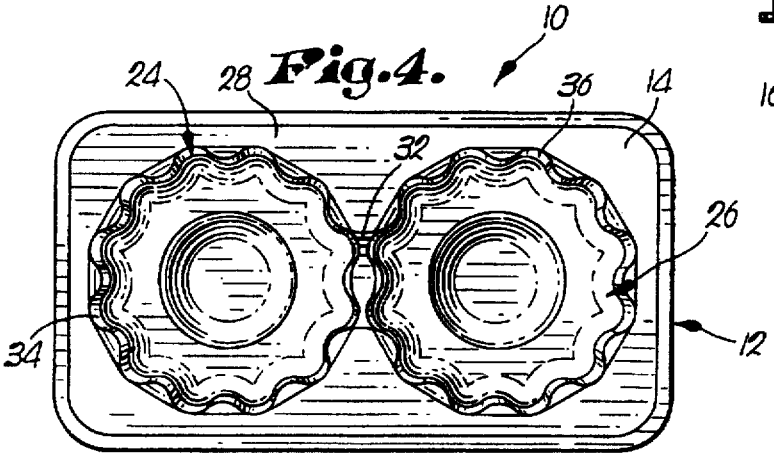
Fig.4.
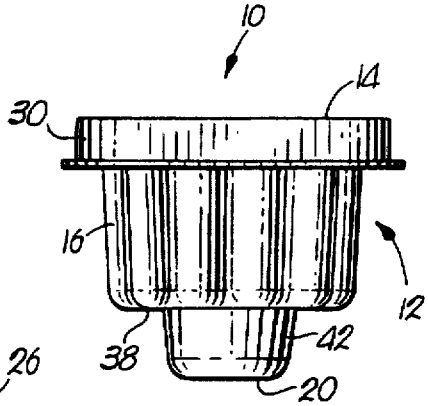
Fig.5.

THERMO-FORMED PACKING ELEMENT FOR FLOURESCENT TUBE

BACKGROUND OF THE INVENTION

1. Field of the Invention

The present invention is broadly concerned with synthetic resin packing elements particularly designed for use with fluorescent tubes in order to provide an economical, breakage-resistant means of packaging pairs of such tubes for shipment and sale. More particularly, the invention pertains to such packing elements, as well as completed fluorescent tube packages, wherein each elements is in the form of a resilient synthetic resin (e.g., polyvinyl chloride) body presenting a pair of juxtaposed tubular members which as manufactured have slightly non-parallel central axes and which are deformed when applied to the ends of fluorescent tubes as an aid in unitizing the final package. In preferred forms, each of the tubular members is configured to present a series of axially extending, concavo-convex deformable ribs along the lengths thereof so that the inner, fluorescent tube-engaging surface of each tubular member has a transversely undulating shape.

2. Description of the Prior Art

Elongated fluorescent tubes are extremely fragile and care must be taken in order to package such tubes for safe transit, storage and sale. In the past, it has been known to support fluorescent tubes using inserts or dunnage elements formed of molded pulp or paperboard. In addition, specialized tube dunnage elements of the type described in U.S. Pat. No. 4,792,045 have been provided. These supports are formed using synthetic resin sheet material and are designed for machine dispensing during packing operations.

In recent years, fluorescent tubes have been sold as pairs and are packaged using shrink wrap film and cardboard end supports. This type of packaging has proved to be satisfactory in the case of standard four foot tubes. However, there is a significant market for longer fluorescent tubes (e.g., eight feet), and shrink wrap packaging of these long tubes is not economically feasible owing to the cost of the film wrap.

Accordingly, there is a need in the art for improved fluorescent tube packing elements which eliminate the need for shrink wrapping, are low in cost, and provide the degree of protection against breakage required by shippers and retailers.

SUMMARY OF THE INVENTION

The present invention overcomes the problems outlined above and provides a packing element for a pair of elongated fluorescent tubes. Broadly speaking, the packing element of the invention is designed to be fitted over the ends of a pair of adjacent fluorescent tubes, and is in the form of a resilient, deformable synthetic resin body which can be thermo-formed from starting sheet stock. The synthetic resin body presents a pair of elongated, juxtaposed, interconnected tubular members each having an entrance opening and a rearward end, wherein each tubular members is adapted to fit over and engage a fluorescent tube end. In preferred forms, the body is formed so that the central axes of the tubular members are in a non-parallel orientation prior to fitting of the tubular members over the fluorescent tube ends. This non-parallel orientation has been found to rigidify and unitize the resultant fluorescent tube package and give greater resistance to breakage.

In further preferred forms, each of the tubular members has a closed rearmost end to present a cup-like configuration. Moreover, the tubular sidewalls are configured to present a series of circumferentially arranged, generally axially extending, concavo-convex ribs along the lengths thereof. At least certain of these ribs are deformable when tubular members are fitted over a fluorescent tube end to enhance the integrity of the final fluorescent package.

The packing elements of the invention can be thermo-formed from sheet stock using a variety of synthetic resin materials such as polyvinyl chloride or polyester. In practice, however, polyvinyl chloride sheets have a nominal thickness of up to about 0.02 inches is preferred, with 0.015 inch thickness PVC material being most preferred.

BRIEF DESCRIPTION OF THE DRAWINGS

FIG. 1 is a perspective view of a packaging element in accordance with the invention, illustrating the entrance openings of the cup-like tube-receiving sockets;

FIG. 2 is a perspective view of the FIG. 1 packaging element, depicting the closed rearward ends of the cup-like sockets;

FIG. 3 is a side elevational view of the packaging element illustrated in FIGS. 1–2;

FIG. 4 is a plan view of the packaging element;

FIG. 5 is an end view of the packaging element;

DETAILED DESCRIPTION OF THE PREFERRED EMBODIMENT

Figure 8:
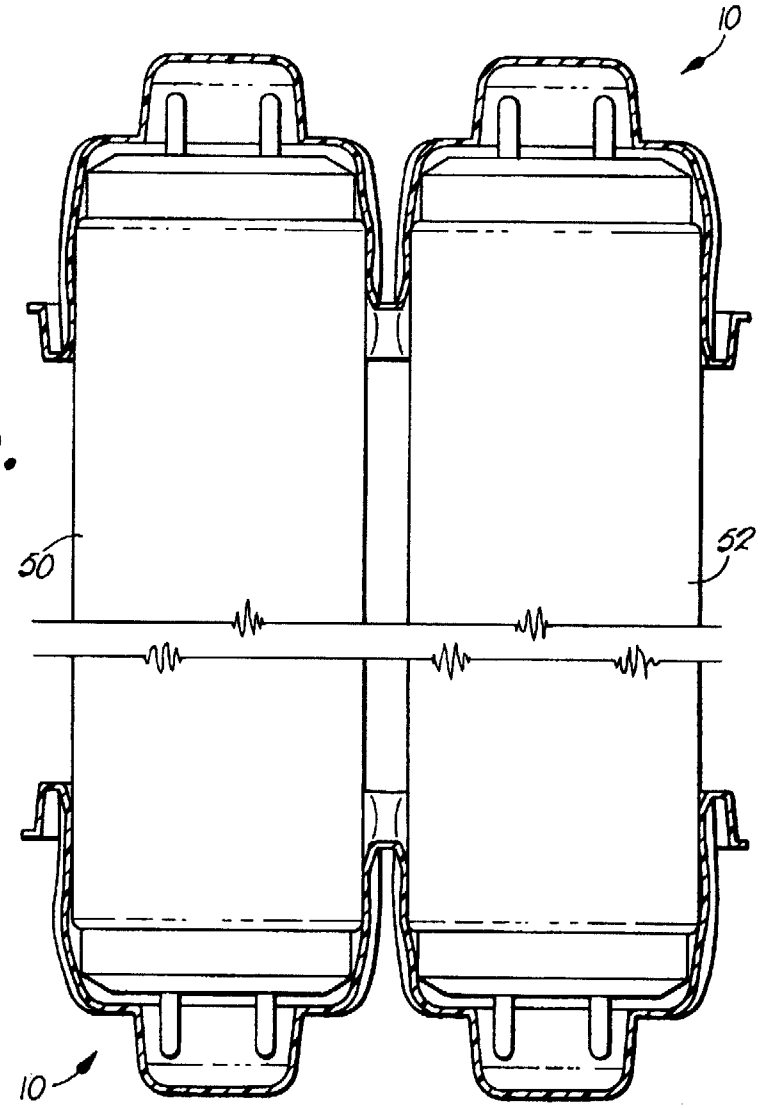
FIG. 8 is a fragmentary sectional view illustrating a complete fluorescent tube package in accordance with the invention including a pair of fluorescent tubes and a packing element in accordance with the invention installed over each adjacent pair of tube ends.
Figure 6:
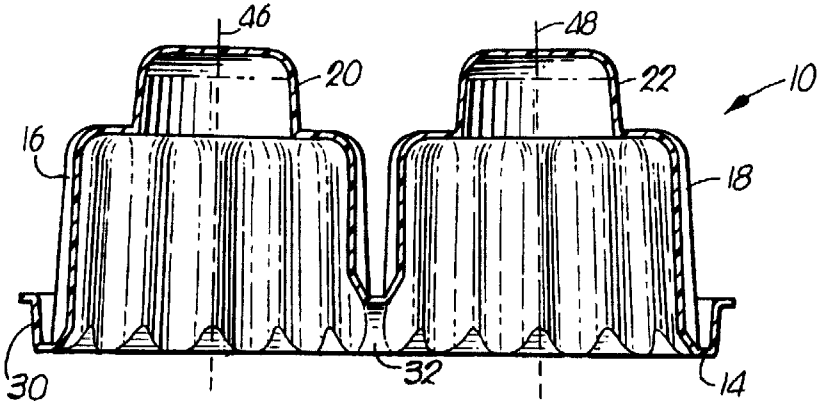
FIG. 6 is a vertical sectional view of the preferred packaging element illustrating the undulating configuration of the tubular sidewalls of the sockets and the preferred non-parallel orientation of the central axes of the sockets.

Turning now to the drawings and particularly FIGS. 1–5, it will be seen that a packing element 10 in accordance with the invention is in the form of an integral, thermo-formed, synthetic resin body 12 preferably formed from 0.015 inch PVC sheet stock. The body 12 includes an upper wall section 14 as well as a pair of depending, elongated, juxtaposed tubular members 16, 18 having closed ends 20, 22. Referring to FIGS. 1 and 4, it will be observed that the walls 16, 18 also present a pair of side-by-side entrance openings 24, 26 leading to the interior of the members 16, 18.

In more detail, the upper wall section 14 includes a substantially planar primary wall 28 as well as a depending, circumscribing external flange 30. It will be noted that the wall 28 is transverse to the longitudinal axis of the members 16, 18, and that a short, concave wall segment 32 is joined to the wall 28 at the area of closest adjacency of the members 16, 18. Each of the members 16, 18 is configured to present a series of circumferentially arranged, axially extending, elongated concavo-convex ribs 34, 36 such that each tubular member presents a transverse, undulating, fluorescent tube-engaging internal surface. The end caps 20, 22 each include a transverse annular wall 38, 40 as well as a short, closed-ended prong-receiving extension 42, 44.

It will thus be seen that the tubular members 16, 18, and their corresponding ends 20, 22 cooperatively define a pair of cup-like members each having a tubular sidewall, an entrance opening and a closed rearward end.

In preferred forms, the body 10 is manufactured so that the central axes 46, 48 of the tubular members 16, 18 are in a non-parallel orientation. As best illustrated in FIG. 5, the axes 46, 48 have a small included angle therebetween of up to about 10°, more preferably up to about 5°, and most preferably about 2°. It will moreover be seen that the axes 46, 48 are oriented such that they are closer together at the closed ends 20, 22, as compared with their relative spacing at the entrance openings 24, 26.

Figure 7:
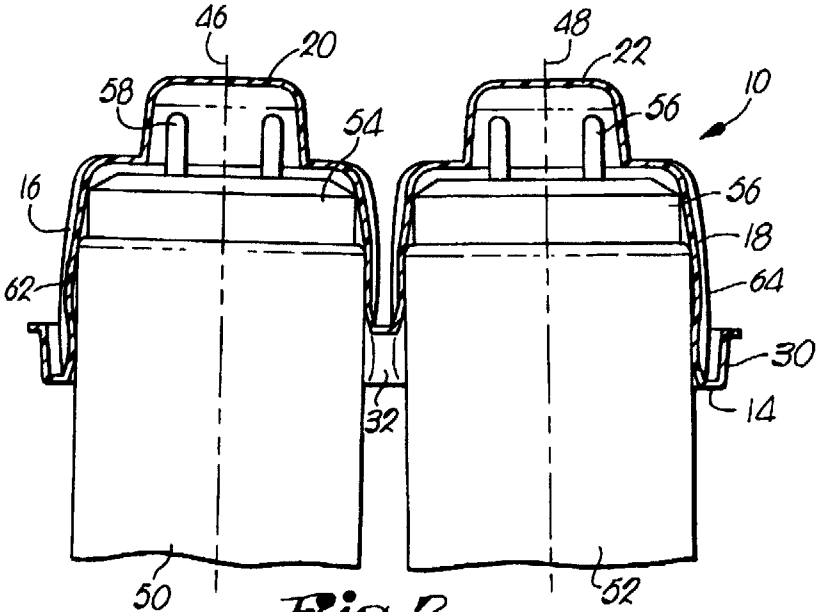
FIG. 7 is a sectional view similar to that of FIG. 6 but depicting the packaging element properly affixed over the ends of a pair of fluorescent tubes.

FIGS. 7 illustrates the configuration of a packing element 10 after application to the ends of a pair of fluorescent tubes 50, 52. As seen, each of the tubes 50, 52 includes a metallic end cap 54, 56 as well as a pair of connection prongs 58, 60. As the tubular members 16, 18 are fitted onto the ends of the tubes 50, 52, the body 10 is deformed so that the central axes 46, 48 are substantially parallel with each other. In addition, the force-fitting of the members 16, 18 onto the fluorescent tubes causes at least certain of the ribs 34, 36 to deform and bulge outwardly as shown at 62, 64. This insures that the packing element 10 is positively secured in place, and moreover strengthens the resultant package.

FIG. 8 depicts a completed fluorescent tube package 66 made up of a pair of fluorescent tubes 50, 52 with a pair of packing elements 10 mounted on the opposed ends of the adjacent fluorescent tubes.

I claim:

1. A packing element for a pair of elongated fluorescent tubes and comprising:

a resilient synthetic resin body presenting a pair of elongated, juxtaposed, interconnected tubular members each having an entrance opening and a rearward end, said members being adapted to fit over and engage the end of a fluorescent tube, each of said tubular members having a central axis and wherein the axes of the tubular members are in a non-parallel orientation prior to fitting of the tubular members over said fluorescent tube ends.

2. The packing element of claim 1, said rearward ends being closed whereby the members have a cup-like configuration.

3. The packing element of claim 1, wherein said axes are oriented such that the axes are closer together at said rearward ends of said tubular members, and are farther apart at said entrance openings.

4. The packing element of claim 1, said body being integral.

5. The packing element of claim 1, each of said tubular members having a series of circumferentially arranged, generally axially extending, concavo-convex ribs along the lengths thereof.

6. The packing element of claim 5, at least certain of said ribs being deformable when the corresponding tubular member is fitted over and engages the end of a fluorescent tube.

7. The packing element of claim 1, including a transverse wall adjacent said entrance openings and interconnecting said tubular members, there being a concave wall segment joined to said transverse wall at the area of closest adjacency of said tubular members.

8. The packing element of claim 1, said body being formed of polyvinyl chloride.

9. The packing element of claim 1, said body being thermoformed from polyvinyl chloride sheet material having a thickness of up to about 0.020 inches.

10. A packing element for a pair of elongated fluorescent tubes and comprising:

a resilient synthetic resin body presenting a pair of elongated, juxtaposed, interconnected cup-like members each having a tubular sidewall, an entrance opening and a closed rearward end, said members being adapted to fit over and frictionally engage the end of a fluorescent tube, each of said tubular sidewalls having a series of circumferentially arranged, generally axially extending, concavo-convex ribs along the lengths thereof, at least certain of said ribs being deformable when the corresponding member is fitted over and engages the end of a fluorescent tube.

11. The packing element of claim 10, said body being integral.

12. The packing element of claim 10, including a transverse wall adjacent said entrance openings and interconnecting said tubular members, there being a concave wall segment joined to said transverse wall at the area of closest adjacency of said tubular members.

13. The packing element of claim 10, said body being formed of polyvinyl chloride.

14. The packing element of claim 10, said body being thermoformed from polyvinyl chloride sheet material having a thickness of up to about 0.020 inches.

15. A fluorescent tube package comprising:

a pair of elongated fluorescent tubes oriented in side-by-side relationship with each of the tubes presenting a pair of metallic connection prongs at each end thereof; and a pair of unitary synthetic resin packing element respectively fitted over and frictionally engaging the adjacent ends of said fluorescent tubes, each of said packing elements having a body presenting a pair of elongated, juxtaposed, interconnected tubular members each having an entrance opening and a rearward end, said members fitting over and engaging the end of a fluorescent tube, each of said tubular members having a central axis and wherein the axes of the tubular members are in a non-parallel orientation prior to fitting of the tubular members over said fluorescent tube ends, said axes being substantially parallel as fitted over and engaging said fluorescent tube ends.

16. The package of claim 15, said rearward ends being closed whereby the members have a cup-like configuration.

17. The package of claim 15, wherein said axes prior to said fitting are oriented such that the axes are closer together at said rearward ends of said tubular members, and are farther apart at said entrance openings.

18. The package of claim 15, said body being integral.

19. The package of claim 15, each of said tubular members having a series of circumferentially arranged, generally axially extending, concavo-convex ribs along the lengths thereof.

20. The package of claim 19, at least certain of said ribs being deformable when the corresponding tubular member is fitted over and engages the end of a fluorescent tube.

21. The package of claim 15, including a transverse wall adjacent said entrance openings and interconnecting said tubular members, there being a concave wall segment joined to said transverse wall at the area of closest adjacency of said tubular members.

22. The package of claim 15, said body being formed of polyvinyl chloride.

23. The package of claim 15, said body being thermoformed from polyvinyl chloride sheet material having a thickness of up to about 0.020 inches.

* * * * *